US008330397B2

(12) United States Patent
Meddaugh

(10) Patent No.: US 8,330,397 B2
(45) Date of Patent: Dec. 11, 2012

(54) DEVICE FOR REDUCING PEAK FIELD AN ACCELERATOR SYSTEM

(75) Inventor: Gard Meddaugh, Mountain View, CA (US)

(73) Assignee: Varian Medical Systems, Inc., Palo Alto, CA (US)

( * ) Notice: Subject to any disclaimer, the term of this patent is extended or adjusted under 35 U.S.C. 154(b) by 819 days.

(21) Appl. No.: 12/211,338

(22) Filed: Sep. 16, 2008

(65) Prior Publication Data

US 2010/0066256 A1 Mar. 18, 2010

(51) Int. Cl.
*H05H 9/00* (2006.01)
*H05J 23/00* (2006.01)

(52) U.S. Cl. ..... 315/505; 315/500

(58) Field of Classification Search ..... 315/500–503, 315/506–507
See application file for complete search history.

(56) References Cited

U.S. PATENT DOCUMENTS

| | | | | |
|---|---|---|---|---|
| 3,820,035 | A * | 6/1974 | Meddaugh | 315/5.13 |
| 5,168,241 | A * | 12/1992 | Hirota et al. | 315/500 |
| 5,418,372 | A * | 5/1995 | Schonberg et al. | 250/492.3 |
| 6,465,957 | B1 * | 10/2002 | Whitham et al. | 315/5.41 |
| 7,786,823 | B2 * | 8/2010 | Heisen et al. | 333/109 |
| 7,863,988 | B2 * | 1/2011 | Baek et al. | 331/5 |
| 8,143,816 | B2 * | 3/2012 | Clayton et al. | 315/500 |
| 2008/0024065 | A1 * | 1/2008 | Yakovlev et al. | 315/5.41 |
| 2010/0038563 | A1 * | 2/2010 | Chen et al. | 250/503.1 |
| 2010/0039051 | A1 * | 2/2010 | Clayton et al. | 315/501 |

* cited by examiner

*Primary Examiner* — Minh D A
(74) *Attorney, Agent, or Firm* — Vista IP Law Group, LLP

(57) ABSTRACT

An apparatus for regulating power in an accelerator system includes a directional coupler for sensing a power reflected from an accelerator towards a power source, and a power modulator for reducing an output of the power source based on the sensed power. A method for regulating power in an accelerator system includes sensing a power reflected from an accelerator towards a power source, and reducing an output of the power source based on the sensed power.

17 Claims, 3 Drawing Sheets

DEVICE FOR REDUCING PEAK FIELD AN ACCELERATOR SYSTEM

FIELD

This invention relates generally to systems that include accelerators, such as electron accelerators and proton accelerators, and more specifically, to devices for reducing peak field in such accelerator systems.

BACKGROUND

Standing wave electron beam accelerators have found wide usage in medical accelerators where the energy electron beam is employed to generate x-rays for therapeutic and diagnostic purposes. Electron beams generated by an electron beam accelerator can also be used directly or indirectly to kill infectious agents and pests, to sterilize objects, to change physical properties of objects, and to perform testing and inspection of objects, such as containers, containers storing radioactive material, and concrete structures.

However, in existing systems, microwave or radio-frequency (RF) power provided by a power generator to an accelerator may be reflected back to the power generator. This condition occurs when the frequency of the power does not match the resonance frequency of the accelerator. Sometimes, the combined effect of the generated power and the reflected power may cause the power generator and the waveguide components to arc. Arc (or arcing) is a condition characterized by having electric field that is so high that gas becomes ionized in an electric field to form a conductive path. In accelerator systems, arcing is not desirable because it may cause a break down at the power generator and waveguide components, and may cause an instability in the operation of the accelerator. Thus, Applicant of the subject application determines that it may be desirable to protect the power generator and waveguide components from arcing, and to prevent or at least reduce an effect of arcing.

SUMMARY

In accordance with some embodiments, an apparatus for regulating power in an accelerator system includes a directional coupler for sensing a power reflected from an accelerator towards a power source, and a power modulator for reducing an output of the power source based on the sensed power.

In accordance with other embodiments, a method for regulating power in an accelerator system includes sensing a power reflected from an accelerator towards a power source, and reducing an output of the power source based on the sensed power.

Other and further aspects and features will be evident from reading the following detailed description of the embodiments, which are intended to illustrate, not limit, the invention.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only typical embodiments and are not therefore to be considered limiting of its scope.

DESCRIPTION OF THE EMBODIMENTS

Figure 1:
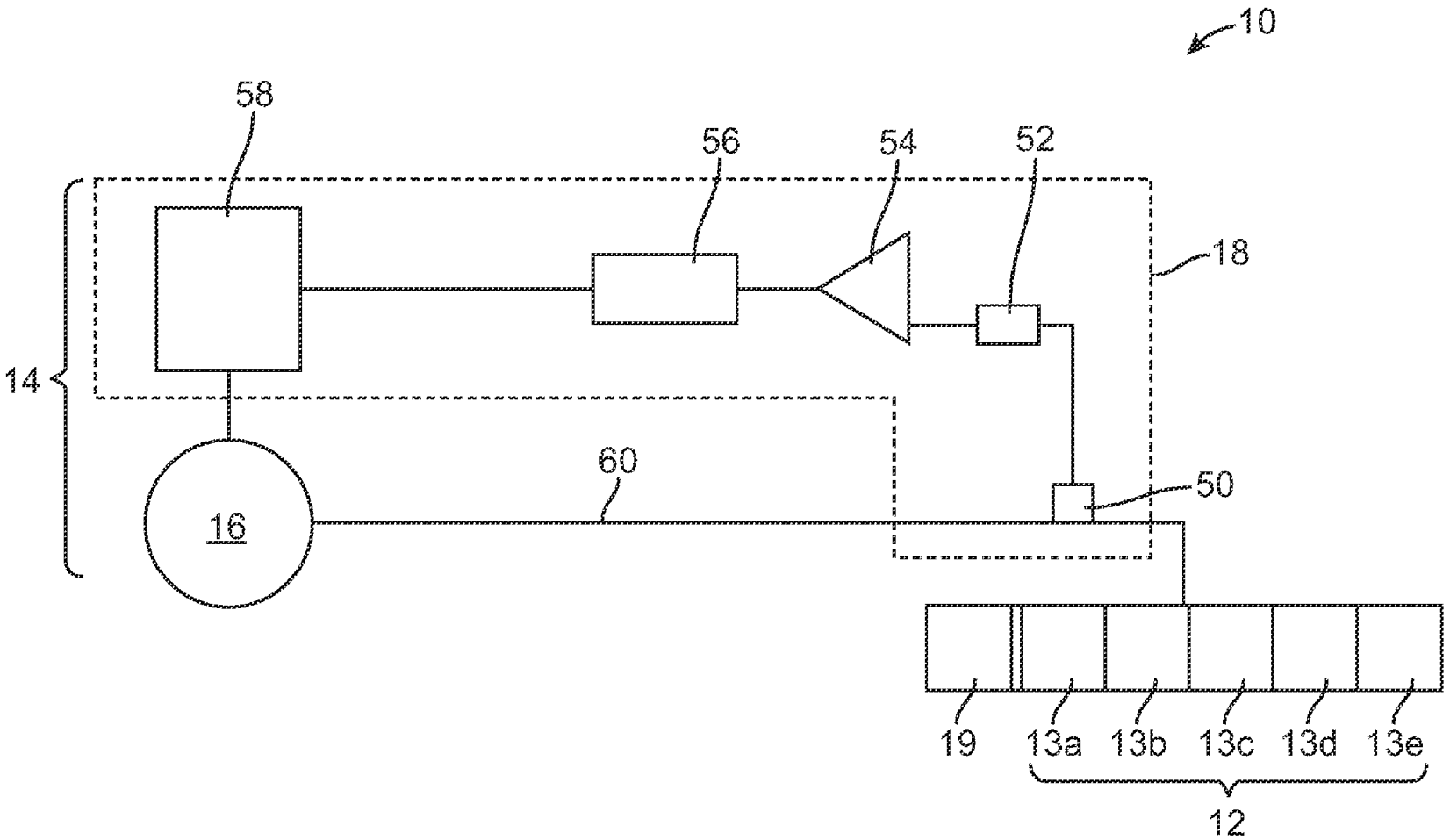
FIG. 1 is a block diagram of an accelerator system having a particle accelerator that is coupled to a power modulator in accordance with some embodiments.

Various embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated.

FIG. 1 is a block diagram of a radiation system 10 having an electron accelerator 12 that is coupled to a power system 14, which includes a power generator 16 and a power modulator system 18 in accordance with some embodiments. The accelerator 12 may be a part of a medical treatment device, such as a radiation machine for delivering treatment radiation beam, or a diagnostic device, such as an imaging machine (e.g., an X-ray machine, a CT machine, etc.). The accelerator 12 includes a plurality of axially aligned cavities 13 (electromagnetically coupled resonant cavities). In the figure, five cavities 13*a*-13*e* are shown. However, in other embodiments, the accelerator 12 can include other number of cavities 13 (e.g., one cavity 13). The radiation system 10 may also include a particle source 19 (e.g., an electron gun) for injecting particles such as electrons into the accelerator 12. During use, the accelerator 12 is excited by power, e.g., microwave power, delivered by the power system 14 at a frequency, for example, at least between 0.5 GHz and 35 GHz. The power generator 16 can be a magnetron, a klystron, both of which are known in the art, or any of other power generating devices that is capable of providing RF power. The power delivered by the power system 14 is in the form of electromagnetic waves. The electrons generated by the particle source are accelerated through the accelerator 12 by oscillations of the electromagnetic waves within the cavities 13 of the accelerator 12, thereby resulting in an electron beam. In some embodiments, the radiation system 10 may further include a computer or processor, which controls an operation of the power system 14. As shown in the figure, the system 10 also includes a transmission line 60 for transmitting output power from the power source 16 to the accelerator 12.

In the illustrated embodiments, the power modulator system 18 includes a directional coupler 50, a detector 52, a comparator 54, a gain regulator 56, and a power modulator 58. In some embodiments, the power modulator 58 and the power source 16 together may be considered a transmitter, and the gain regulator 56 is for controlling an output of the transmitter.

Figure 2:
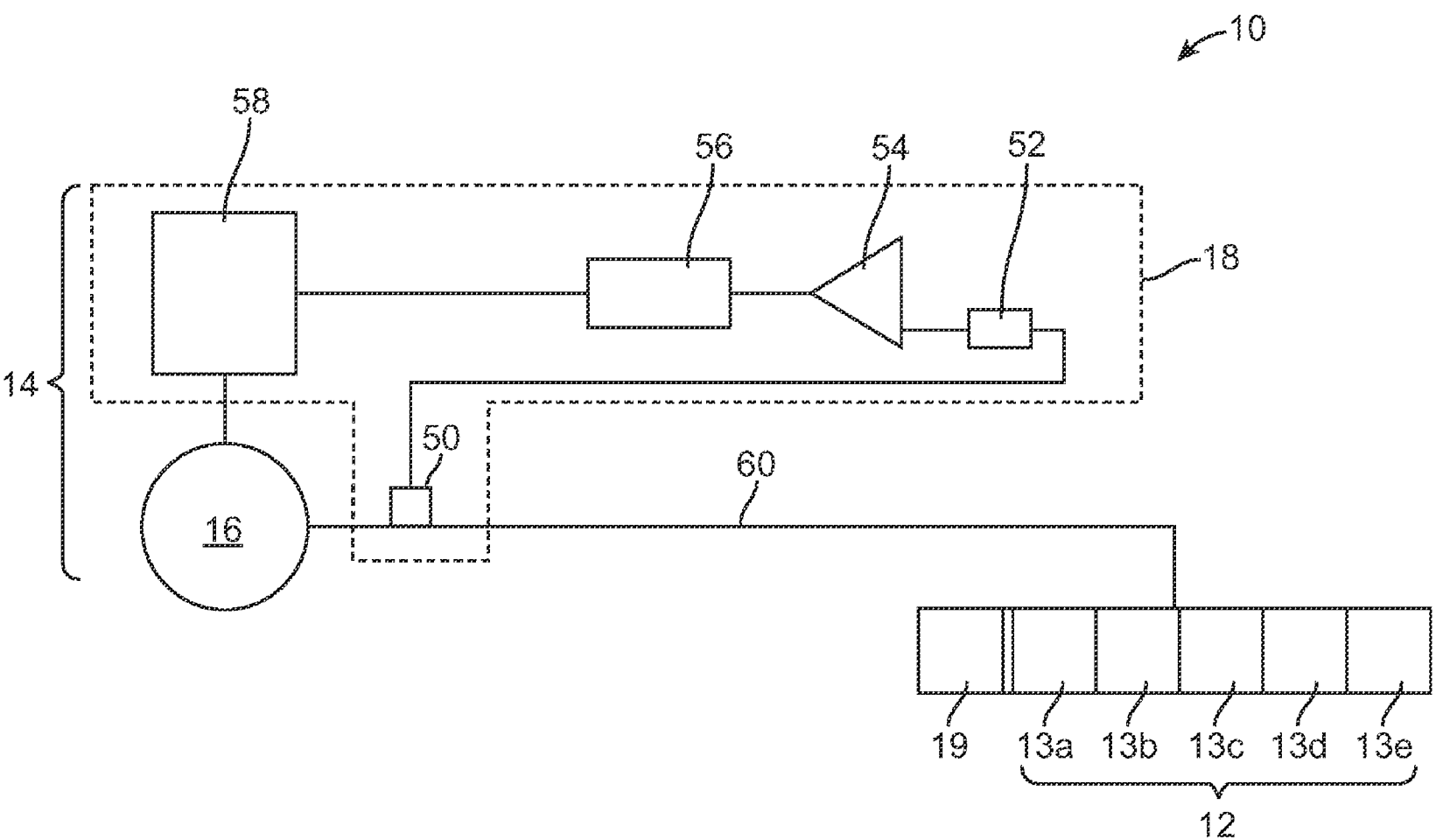
FIG. 2 illustrates a block diagram of an accelerator system having a particle accelerator that is coupled to a power modulator in accordance with other embodiments.

The accelerator 12 may be considered a resonant load and signal (power) reflected therefrom may be subject to change. The directional coupler 50 is configured to sense power reflected back from the accelerator 12 towards the power source. In the illustrated embodiments, the directional coupler 50 is coupled to a distal end of the transmission line 60 (e.g., closer to the accelerator 12). In other embodiments, the directional coupler 50 may be coupled to the system 10 at any location between the power source 16 and the accelerator 12. For example, in other embodiments, the directional coupler 50 may be coupled between the power source 16 and the transmission line 60. Also, in other embodiments, the coupler 50 may be located anywhere along the transmission line 60 at the proximal end, e.g., closer to the power source 16 than the accelerator 12 (FIG. 2). In further embodiments, an optional circulator/isolator may be inserted anywhere along the transmission line 60. In such cases, the directional coupler 50 may be on the accelerator side of the circulator/isolator. The directional coupler 50 may be implemented using any form of a transmission line, such as a circuit, as long as the directional coupler 50 can sense power reflected back from the accelerator 12.

The components 16, 12, 50, 60 can be coupled to each other using one of a variety of devices known in the art. For example, in some embodiments, some of the components discussed herein may be configured (e.g., sized and shaped) to couple to each other using tube(s), waveguide(s), coaxial line(s), stripline(s), microstrip(s), and combination thereof, all of which are well known in the art. Also, in other embodiments, any of the components may be configured (e.g., sized and shaped) to directly connect to another one of the components.

The detector 52 is electrically coupled to the comparator 54, and is configured to provide a current (e.g., a DC current) for the comparator 54 that corresponds with a level of RF power sensed by the directional coupler 50. In some embodiments, the detector 52 functions as an adaptor that interfaces between the directional coupler 50 and the comparator 54. In any of the embodiments described herein, instead of being a component that is separate from the comparator 54 and the directional coupler 50, the detector 52 may be a part of the comparator 54, or alternatively, a part of the directional coupler 50. It should be noted that the detector 52 may be implemented using any device as long as it can convert sensed RF power to current. Devices that are capable of converting a RF signal to current is well known, and may be used to implement the detector 52. For example, in some embodiments, the detector 52 may be a diode detector. Also, in some embodiments, the detector may include an input port for receiving RF power, and an output for providing a current.

The comparator 54 is configured (e.g., built and/or programmed) to compare the output from the detector 52 with a prescribed level. In the illustrated embodiments, the comparator 54 compares the current with the prescribed level by determining a difference between a value of the current and the prescribed level. In other embodiments, the comparator 54 may be configured to compare the current with the prescribed level by performing other operations using the current and the prescribed level. For example, the comparator 54 may apply a factor to the value of the current (e.g., scale it up or down), and then determine a difference between the factored current and the prescribed level. The comparator 54 may be implemented using a processor, a computer, or any other circuit. It should be noted that the term "compare" (and similar terms, such as "comparing"), as used in this specification, is not limited to the act of determining a difference using two values, and may refer to the act of performing any operation using two or more values. Similarly, the term "comparator" as used in this specification is not limited to a device that determines a difference using two values, and may be a device that performs any operation using two or more values.

The gain modulator 56 is configured (e.g., built and/or programmed) to adjust an output from the comparator 54. In the illustrated embodiments, the gain modulator 56 is illustrated as coupled between the comparator 54 and the power modulator 58. In other embodiments, the gain modulator 56 may be a part of the comparator 54, or a part of the power modulator 58. Also, in other embodiments, instead of adjusting the output of the comparator 54, the gain modulator 56 may be configured to adjust the output from the detector 52. In such cases, the gain modulator 56 may be coupled between the detector 52 and the comparator 54, may be a part of the detector 52, or may be a part of the comparator 54. In other embodiments, the power modulator system 18 may include a first gain modulator **56*a* for adjusting the output from the comparator 54, and a second gain modulator 56*b* for adjusting the output from the detector 52. In further embodiments, the power modulator system 18 does not include the gain modulator 56. In such cases, the output of the comparator 54 is transmitted directly to the gain modulator 56**.

The power modulator 58 is configured (e.g., built and/or tuned) to receive an input from the comparator 54/gain modulator 56, and adjust an amplitude of the output power of the power source 16 in response to the received input from the comparator 54/gain modulator 56. For example, in some embodiments, the power modulator 58 comprises a pulse modulator that drives the power source 16, in which case, the power modulator 58 is configured to reduce the amplitude of the pulse from the pulse modulator in order to decrease the output power from the power source 16. In the illustrated embodiments, the power modulator 58 is illustrated as a separate component from the power source 16. In other embodiments, the power modulator 58 may be a component of the power source 16. In further embodiments, any or a combination of the detector 52, the comparator 54, and the gain modulator 56 may be a part of the power modulator 58.

During use of the system 10, a microwave signal (e.g., a pulsed signal, a modulated signal, or continuous wave) is provided from the power source 16 to energize the accelerator 12. In the illustrated embodiments, the microwave signal is a 3-GHz, 4 us pulse, with 100-1000-Hz pulse repetition frequency, and a peak power of 1-10 MW. In other embodiments, the microwave signal can have other characteristics—i.e., with ranges that are different from those described. Also, in further embodiments, the signal needs not be a microwave signal. Depending on an operation condition of the system 10, some power delivered to the accelerator 12 may be reflected from the accelerator 12 towards the power source 16. In such cases, the directional coupler 50 senses the reflected power, and transmits it to the detector 52. The detector 52 converts the RF reflected power into a current (e.g., an electric signal) that represents a magnitude of the RF reflected power, and delivers it to the comparator 54, which compares the current with a prescribed level. The comparator 54 determines an output based on a processing of the current and the prescribed level, and transmits the output downstream. If the power modulator system 18 includes the gain modulator 56, the gain modulator 56 may adjust the output from the comparator 54 before it is transmitted to the power modulator 58. For example, the gain modulator 56 may adjust the output from the comparator 54 by scaling it up or down, and/or adding a constant to it. The power modulator 58 receives the input, and determines whether to adjust the amplitude of the output power by the power source 16 based on the input. For example, the power modulator 58 may be configured (e.g., built and/or programmed) to decrease the amplitude of the output power by the power source 16 if the input signal from the comparator 54/gain modulator 56 indicates that the reflected power exceeds a certain threshold. In such cases, the power modulator 58 does not decrease the amplitude of the output power by the power source 16 when the reflected power is below the threshold. In some cases, the power modulator 58 is configured to regulate on the sum of the forward and reflected wave amplitude, which may be equal to, or just greater than, the normal operating condition. For example, in some embodiments, the power modulator 58 is configured to keep the sum of the forward and reflected voltage waves below a prescribed limit.

In some embodiments, the power modulator 58 may be configured to decrease the output power by the power source 16 by a prescribed amount regardless of how much the reflected power exceeds the threshold. In other embodiments, the power modulator 58 may be configured to decrease the output power by the power source 16 by an amount that depends on the magnitude of the reflected power. For example, the power modulator 58 may reduce the output power by the power source 16 by an amount that is proportional to the magnitude of the reflected power, or proportional to the amount of reflected power that exceeds the threshold. In other embodiments, the amount of adjustment for the output power by the power source 16 may be positively correlated in other ways (e.g., logarithmically) with the amount of reflected power or with the amount of reflected power that exceeds the threshold.

In any of the embodiments described herein, the reflected power threshold may be input by a user to the power modulator system 18. For example, in some embodiments, the power modulator system 18 may include a control, such as a knob, a button, etc., coupled to the comparator 54 for setting the reflected power threshold. In such cases, the control may be operated to set a prescribed current level that corresponds with the reflected power threshold. In other embodiments, a user interface, such as a keyboard, a mouse, a keypad, etc., may be provided to input a value that represents the reflected power threshold. The input value may be stored in a memory that couples to the comparator 54. In some embodiments, the memory may be a part of the comparator 54, or a part of any of the components of the power modulator system 18.

As illustrated in the above embodiments, the power modulator system 18 is advantageous in that it prevents excessive electric fields associated with arcing from occurring by reducing the amplitude of the output power from the power source 16 when the reflected power is at a level that may be dangerous to the power source 16 or any part of the accelerator system 10. In particular, by reducing the output power, the power modulator system 18 reduces the peak field resulted from the sum of the forward and reflected voltage waves, which may otherwise cause a breakdown in the waveguide or instability in the power source under unsatisfactory operating conditions, such as off-resonance operation (i.e., when the frequency of the power does not match the resonance frequency of the waveguide). Also, the power modulator system 18 is beneficial in that it may prevent formation of high electric fields in the output cavity of the power source 16 (e.g., cavity of Klystron), thereby protecting the power source 16. In some cases, the power modulator system 18 may also prevent a RF field in the waveguide from becoming too high (e.g., doubling) due to reflected power.

Figure 3:
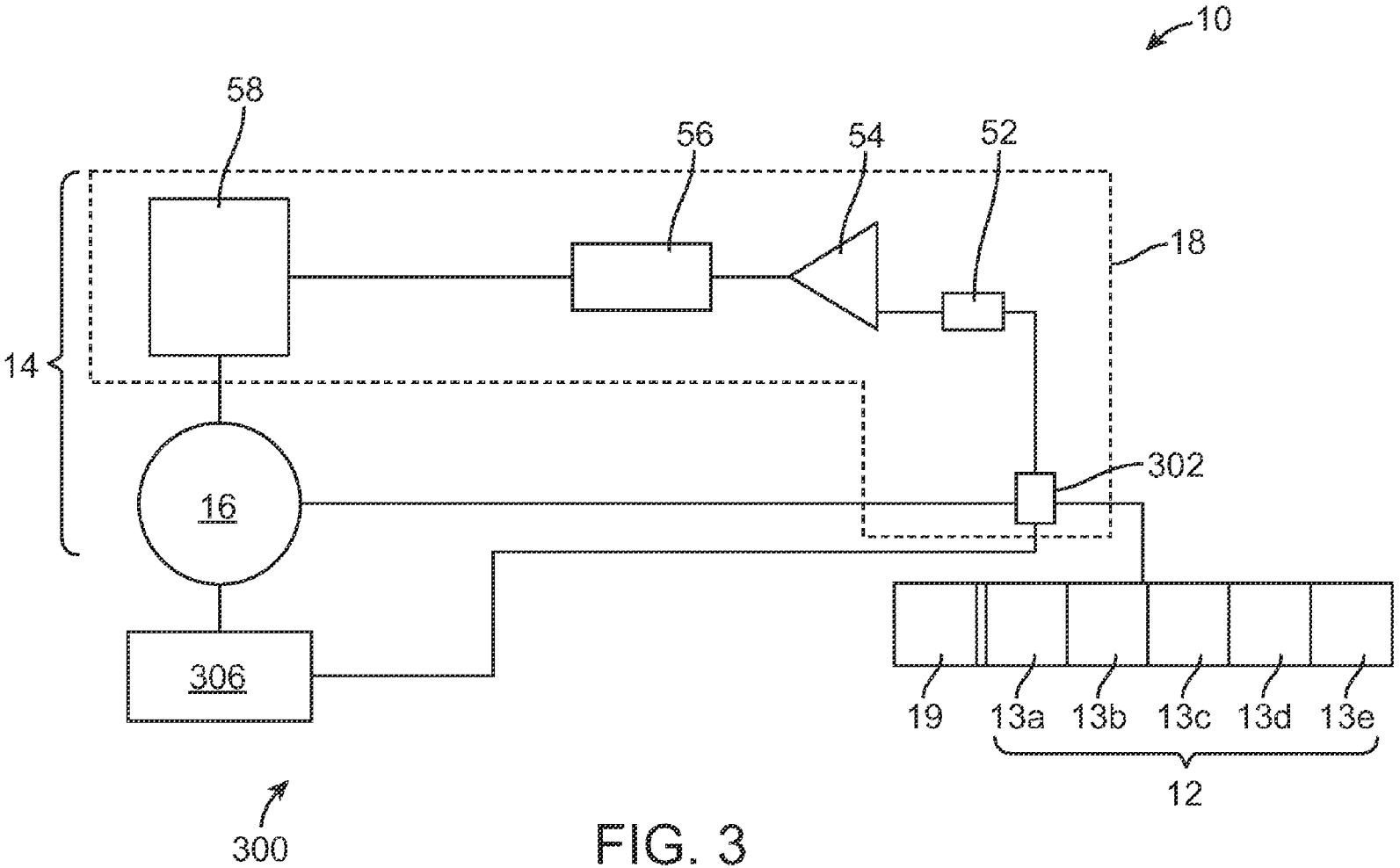
FIG. 3 illustrates a block diagram of an accelerator system having a particle accelerator that is coupled to a power modulator and a frequency control in accordance with some embodiments.

In any of the embodiments described herein, the system 10 may further include a frequency control, such as an automatic frequency control. In some embodiments, such frequency control provides additional control of the power for the accelerator 12 from that of the power modulator system 18. FIG. 3 illustrates a block diagram of an accelerator system 10 having a particle accelerator 12 that is coupled to a power modulator system 18 and a frequency control 300 in accordance with some embodiments. The frequency control 300 includes a bi-directional coupler 302 for sampling forward power (microwave signal) and power reflected back towards the power source 16, and a processor 306 for performing an analysis using the sampled forward power and reflected power. Signal reflected from the accelerator 12 contains information that may be used to determine the accelerator 12's resonance frequency. The frequency control 300 may use such information to provide a frequency-locking action for the power source 16. For example, in some embodiments, the frequency control 300 includes a microwave circuit that receives a reflected signal and a forward signal sensed by the coupler 302, and provides an output that represents a relative phase between the reflected signal and the forward signal. Based on the output, the frequency control 300 may adjust a frequency of the power source 16 so that it is the same as, or closer to, the resonance frequency of the accelerator 12. Thus, the frequency control 300 is desirable because it allows the reflected power to be controlled in phase so that the frequency of the power generator 16 will be "pulled" to the accelerator 12 frequency, resulting in a stable operation of the power generator 16 and the accelerator 12. If the reflected power is not controlled, the frequency of the power generator 16 may be pulled away from that of the accelerator 12, resulting in difficulty of getting the power generator 16 to operate stably and reliably at the frequency that is optimal for accelerator's 12 performance. In some embodiments, the frequency control 300 is an automatic frequency control (AFC) that automatically performs the above described function. Automatic frequency control has been described in U.S. Pat. No. 3,820,035, the entire disclosure of which is expressly incorporated by reference herein. In other embodiments, instead of being separate from the power modulator system 18, the automatic frequency control 300 may be a part of the power modulator system 18. In some embodiments, the operation of the power modulator system 18 and the operation of the AFC are compatible with each other, or may affect one another. For example, in some cases when the system is not working optimally, reducing the power level has the effect of reducing the AFC gain.

As shown in FIG. 3, the coupler 302 of the AFC is coupled to the transmission line 60 for sensing power to and/or from the accelerator 12. The power modulator system 18 may be coupled to the coupler 302 for obtaining sensed reflected power from the accelerator 12. Thus, the same coupler 302 may be used by the AFC and the power modulator system 18. In such cases, since the bi-directional coupler 302 is capable of sensing reflected power from the accelerator 12, the directional coupler 50 is not needed. In other embodiments, the AFC may include a first directional coupler for sensing forward power towards the accelerator 12, and a second directional coupler for sensing reflected power. In such cases, the second directional coupler may be the directional coupler 50 discussed herein. In further embodiments, the coupler 302 of the AFC may be separate and different from the coupler 50 of the power modulator system 18.

It should be noted that FIGS. 1-3 illustrate schematic diagrams of different embodiments of the system 10, and therefore, the actual implementation of the system 10 does not necessarily require the components to be located relatively to each other as that shown in the figures. Thus, in different embodiments of the system 10, the components can be located relative to each other in manners that are different from that shown in FIGS. 1-3.

Also, it should be noted that the power modulator system 18 is not limited to the example discussed previously, and that the power modulator system 18 can have other configurations in other embodiments. For example, in other embodiments, the power modulator system 18 needs not have all of the elements shown in the above embodiments. Also, in other embodiments, two or more of the elements may be combined, or implemented as a single component. In further embodiments, the power modulator system 18 may be used for other types of particle accelerators, such as proton accelerators. Further, the power modulator system 18 is not limited to use in the medical field (e.g., radiation treatment and/or imaging), and may be used in other areas as well. For example, the power modulator system 18 may be used in the object inspection field, in which case, the accelerator 12 may be a part of an inspection device, such as a cargo inspection device, or a part of an irradiating device for irradiating food or other products. In other embodiments, the power modulator system 18 may be used with, or may be a part of, an irradiator, a radar transmitter, a RF transmitter, a microwave oven, or any device that is capable of generating a beam. Further, in any of the embodiments described herein, the power modulator system 18 may be a part of, or may work with, a pulse system that involves a sampling-and-hold circuit. In pulsed applications, a sample-and-hold circuit could be used to differentiate between the major portion of the pulse and the (short) transients caused by the filling and discharge of the resonant cavity.

Although particular embodiments have been shown and described, it will be understood that they are not intended to limit the present inventions, and it will be obvious to those skilled in the art that various changes and modifications may be made without departing from the spirit and scope of the present inventions. The specification and drawings are, accordingly, to be regarded in an illustrative rather than restrictive sense. The present inventions are intended to cover alternatives, modifications, and equivalents, which may be included within the spirit and scope of the present inventions as defined by the claims.

What is claimed:

1. An apparatus for regulating power in an accelerator system, comprising:

a directional coupler for sensing a power reflected from an accelerator towards a power source; and a power modulator for reducing an output of the power source based on the sensed power;

wherein the power modulator is configured to reduce the output of the power source when the sensed power exceeds a prescribed level.

2. The apparatus of claim 1, further comprising a control for setting the prescribed level.

3. The apparatus of claim 1, further comprising a comparator for comparing the sensed power with the prescribed level.

4. The apparatus of claim 3, further comprising a detector coupled between the directional coupler and the comparator.

5. The apparatus of claim 4, wherein the detector has an input port for receiving RF power, and an output for providing a current.

6. The apparatus of claim 1, further comprising a gain regulator for adjusting a difference between the sensed power and the prescribed level.

7. An apparatus for regulating power in an accelerator system, comprising:

a directional coupler for sensing a power reflected from an accelerator towards a power source; and a power modulator for reducing an output of the power source based on the sensed power;

wherein the power modulator is configured to reduce the output of the power source when a voltage representing the sensed power exceeds a prescribed level.

8. The apparatus of claim 7, further comprising a user interface coupled to the memory for allowing a user to input the prescribed level.

9. A method for regulating power in an accelerator system, comprising:

sensing a power reflected from an accelerator towards a power source; and reducing an output of the power source based on the sensed power;

wherein the output of the power source is reduced when the sensed power exceeds a prescribed level.

10. The method of claim 9, further comprising receiving the prescribed level from a user.

11. The method of claim 9, wherein the prescribed level is set by a user using a control.

12. The method of claim 9, further comprising comparing the sensed power with the prescribed level.

13. A method for regulating power in an accelerator system, comprising:

sensing a power reflected from an accelerator towards a power source; and reducing an output of the power source based on the sensed power;

wherein the output of the power source is reduced when a voltage representing the sensed power exceeds a prescribed level.

14. A method for regulating power in an accelerator system, comprising:

sensing a power reflected from an accelerator towards a power source;

reducing an output of the power source based on the sensed power;

converting the sensed power into a current; and comparing the current with a prescribed level.

15. The method of claim 14, wherein the act of comparing comprises determining a difference between the current and the prescribed level.

16. The method of claim 15, further comprising amplifying the difference.

17. The method of claim 16, wherein the act of controlling is performed to reduce the output of the power source based on the amplified difference.

* * * * *